US005578113A

United States Patent [19]

Glenn

[11] Patent Number: 5,578,113

[45] Date of Patent: Nov. 26, 1996

[54] AIR TREATMENT SYSTEM

[75] Inventor: Neville R. Glenn, Milford, Mass.

[73] Assignee: Holmes Product Corp., Milford, Mass.

[21] Appl. No.: 277,441

[22] Filed: Jul. 19, 1994

[51] Int. Cl.[6] ..... B03C 3/014

[52] U.S. Cl. ..... 96/52; 55/234; 55/422; 55/DIG. 39; 96/57; 96/97; 261/107

[58] Field of Search ..... 55/233, 234, 422, 55/DIG. 39; 96/52, 97, 57; 261/99, 104, 107, DIG. 17

[56] References Cited

U.S. PATENT DOCUMENTS

| | | | |
|---|---|---|---|
| 2,638,644 | 5/1953 | Ravhvt | 55/234 |
| 3,757,494 | 9/1973 | Keuls | 261/104 X |
| 4,042,357 | 8/1977 | Gysi | 55/417 |
| 4,102,656 | 7/1978 | Koritz | 55/234 X |
| 4,252,547 | 2/1981 | Johnson | 55/234 X |
| 4,597,781 | 7/1986 | Spector | 96/52 |
| 4,829,781 | 5/1989 | Hitzler | 62/311 |
| 5,061,405 | 10/1991 | Stanek et al. | 261/104 X |
| 5,067,169 | 11/1991 | Chiu | 392/406 |
| 5,133,904 | 7/1992 | Pepper | 261/24 |
| 5,143,655 | 9/1992 | Chiu et al. | 261/107 X |
| 5,250,232 | 10/1993 | Pepper et al. | 261/107 X |
| 5,268,009 | 12/1993 | Thompson et al. | 55/DIG. 39 |

FOREIGN PATENT DOCUMENTS

| | | | |
|---|---|---|---|
| 60-177614 | 9/1985 | Japan | 96/52 |
| 6-47232 | 2/1994 | Japan | 55/DIG. 39 |
| 6-55023 | 3/1994 | Japan | 55/DIG. 39 |

*Primary Examiner*—Richard L. Chiesa
*Attorney, Agent, or Firm*—Hoffmann & Baron

[57] ABSTRACT

An air treatment system includes a housing having a from cylindrical chamber and a rear rectangular chamber, the front and rear chambers being separated by an internal wall. The front chamber is provided with a series of outlet vents, the rear chamber is provided with a series of inlet vents, and the internal wall is provided with a series of interchamber vents. A pair of electrically-powered cylindrical fan blades are disposed within the front chamber and are used to draw air into the rear chamber through the inlet vents, to move the air from the rear chamber to the front chamber through the interchamber vents and to exhaust the air from the front chamber through the outlet vents. A plurality of ionizer needles are also disposed within the front chamber. The rear chamber is shaped to include a generally rectangular reservoir. The air treatment system also includes a water tank removably mounted within the rear chamber for use in supplying water to the reservoir. The air treatment system additionally includes a pair of alternative filter assemblies which are positionable in the reservoir. The first filter assembly, which is intended to be used when the reservoir is filled with water so as to provide both air purification and humidification, includes a purification component and a humidification component. The purification component includes an electric filter and an activated charcoal filter, both of which are housed within a metal frame. The humidification component includes a honeycomb-shaped wicking filter and a pair of aluminum frames, the frames being mounted on the front and back sides of the wicking filter. The second filter assembly, which is intended to be used when water is not present in the reservoir so as to provide only air purification, includes a HEPA filter and an activated charcoal filter, both of which are housed within a cardboard frame.

12 Claims, 3 Drawing Sheets

AIR TREATMENT SYSTEM

BACKGROUND OF THE INVENTION

The present invention relates generally to air treatment systems, such as air purifiers, air humidifiers and combinations thereof, and more specifically to a novel air treatment system.

It is often desirable to alter the quality of air present in a house, office or other enclosed space. For example, in the allergy seasons, spanning approximately from April to October, it is often desirable to remove allergens from air present in an enclosed space since such allergens may cause sneezing, congestion and/or breathing problems to certain persons exposed thereto. Also, regardless of the time of the year, there are other sources of air pollutants, such as tobacco smoke, which can be irritating to people exposed thereto and which it would be desirable to remove from air.

Furthermore, in the wintertime, it is often desirable to humidify the air present within an enclosed space since such air is frequently very dry due to heaters used to raise the temperature of the air. Dry air is undesirable for many people because it often results in blocked nasal passages, breathing difficulty, and sinus pressure and headaches related therewith.

Air purifiers are well-known devices used to remove allergens and other pollutants from air. An example of a window mounted air purifier is disclosed in U.S. Pat. No. 4,042,357 to Gysi, which issued on Aug. 16, 1977. In this patent, there is disclosed a filter unit having a central member of substantially rectangle cross section and made up of one or more interconnected sections and having ends slidably fitting into end members of the same cross-section. The central member is formed with ventilating apertures in front and rear walls thereof through which air can flow, and a filter medium is positioned in each section so that the air must flow therethrough. Filler strips are formed on and extend the length of the upper and lower edges of the end members so that said unit has continuous upper and lower edges in common upper and lower planes and extending the length thereof.

It should be noted that the above-described air purifier has certain drawbacks. For instance, because the aforementioned air purifier is intended to be mounted in a window, it must, in many instances, be removed from the window when it is desired to clean or change the air filter or in the wintertime when it is desired to keep warm air in the enclosed space. However, as can readily be appreciated, removal of the air purifier from the window causes the air to be unfiltered.

Ionizers, as well as combination air purifier/ionizers, are other well-known devices used to alter the quality of air in an enclosed space. An ionizer typically includes one or more electrically charged ionizer needles which impart a negative charge to air particles passing through the electric field created by the ionizer needles. The negatively charged air particles attract particulates, such as allergens or other pollutants, which carry a positive charge. The attraction between, the negatively charged air particles and the positively charged particulates causes the positively charged particulates to become neutrally charged, and as a result, to fall from the air to the ground.

As can be appreciated, air purifiers, ionizers or combinations thereof can only purify air and do not also humidify the air being purified.

Air humidifiers (or simply "humidifiers") are also well-known devices used to maintain the proper level of humidity in an enclosed space. An example of a humidifier is disclosed in U.S. Pat. No. 5,133,904 to Pepper, which issued on Jul. 28, 1992. In this patent, a humidifier is described which comprises a cabinet including a top wall having therein an air outlet, a bottom wall having therein an air inlet, and a water reservoir having portions on opposite sides of the air inlet, a wicking element including generally horizontally spaced-apart peripheral portions each located above a respective one of the reservoir portions, and also including a central portion located between the peripheral portions and above the inlet, material for transferring water from one of the reservoir portions to the respective peripheral portion of the wicking element and for transferring water from the other of the reservoir portions to the respective peripheral portion of the wicking element, and a fan supported by the cabinet and located above the wicking element for forcing air flow in a substantially vertical direction through the inlet and the central portion of the wicking element and out the outlet.

As can be appreciated, a humidifier as described above can only humidify air and does not also purify the air being humidified.

Combination air purifier/humidifiers are also well known. One example of a combination air purifier/humidifier is disclosed in U.S. Pat. No. 4,829,781 to Hitzler, which issued on May 16, 1989. In this patent, an appliance for purifying, humidifying or dehumidifying, cooling or heating gases, especially room air is disclosed. This appliance carries out purification by means of a plate stack rotating in a liquid. To regulate or vary the air humidity, the incoming air is conveyed through an evaporator and the purified out going air is conveyed through a condenser of a refrigerant circuit. The effectiveness of the condenser is influenced by an additional condenser.

Another example of a combination air purifier/humidifier is disclosed in U.S. Pat. No. 3,757,494 to Keuls, which issued on Sep. 11, 1973. In this patent, a window-mounted air purifier and humidifier is described, the air purifier/air humidifier comprising a two-part casing or housing, one of which parts has a wall for inlet of external air and is formed at its lower end with a well portion for containing a supply of water and for holding a partially submerged air scrubber or wick. The other part of the casing serves as a closure and constitutes a portion of the top wall and a portion of the front wall of the casing. Means are formed on the exterior of the casing to enable it to be mounted on the window sill in a position such that not more than about one-half of its depth protrudes into the interior of the room.

The primary drawback of the devices described in the two aforementioned patents is that neither device addresses the fact that different types of problems involving air quality occur at different times during the year. For example, as noted above, allergens, such as pollen, are the principal problem affecting air quality in the summertime whereas dry air and pollutants, like tobacco smoke, are the principal problems affecting air quality in the wintertime.

SUMMARY OF THE INVENTION

It is an object of the present invention to provide a new and improved air treatment system.

It is another object of the present invention to provide an air treatment system which overcomes at least some of the problems and drawbacks described above in connection with existing air treatment systems.

According to one feature of the present invention, an air treatment system is provided which includes (a) a housing, said housing including a reservoir; (b) fan means mounted within said housing for circulating air therethrough; (c) water supply means mounted within said housing and in fluid communication with said reservoir; (d) a first filter assembly, said first filter assembly including an air filter and a wicking filter; and (e) a second filter assembly, said second filter assembly including an air filter, said first filter assembly and said second filter assembly being alternatively removably positionable in said reservoir of said housing. In the wintertime, when it is desirable to humidify as well as to purify air, the water supply means is filled with water and placed in the housing so as to fill the reservoir with water, and the first filter assembly is inserted into the housing, with its wicking filter extending into the filled reservoir. In the summertime, when it is desirable to filter allergens and other particulates from air, the water supply means is either removed from the housing or not filled with water, and the second filter assembly is positioned in the empty reservoir.

As can be appreciated, one advantage of the above-described system is that it is capable of accommodating the different air treatment needs associated with the various seasons of the year.

According to another feature of the present invention, an air treatment system is provided which comprises (a) a housing, said housing including a reservoir; (b) fan means mounted within said housing for circulating air therethrough; (c) water supply means mounted within-said housing and in fluid communication with said reservoir; (d) a wicking filter positioned in said reservoir for use in humidifying the air circulated through said housing; (e) an air filter mounted in said housing for purifying the air circulated through said housing; and (f) means for ionizing the air circulated through said housing.

An advantage of this system is that it effectively combines the attributes of air purifiers, humidifiers and air ionizers.

It is another object of the present invention to provide a new and improved filter assembly for use in an air treatment system.

According to one feature of the present invention, such a filter assembly comprises an air humidification component and an air purification component. The humidification component comprises a wicking filter which is a conventional honeycombed-shaped water absorbent material which takes up water from the reservoir by capillary action. The humidification component also includes a pair of aluminum frames which are fixedly attached to the front and back sides, respectively, of the wicking filter and which are used to impart structural rigidity thereto. The air purification filter component comprises a metallic rectangular frame fixedly attached to the back of the rear aluminum frame. An activated charcoal filter and an electrostatically charged electric filter are both housed within the rectangular frame. The electric filter, which is disposed at the rear of the frame, removes airborne particulates, such as tobacco smoke, dust, and pollen from the air passing therethrough. The charcoal filter, which is disposed at the front of the frame, then removes odors from the air passing therethrough.

An advantage of this filter assembly is that it can be used, replaced, and stored as one unit.

It is yet another object of the present invention to provide a new and improved wicking assembly.

According to one feature of the present invention, such a wicking assembly includes a wicking filter and a pair of aluminum frames, said aluminum frames being fixedly attached to the front and back sides of the wicking filter to impart structural rigidity to said wicking filter when moistened.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF A PREFERRED EMBODIMENT

Figure 1:
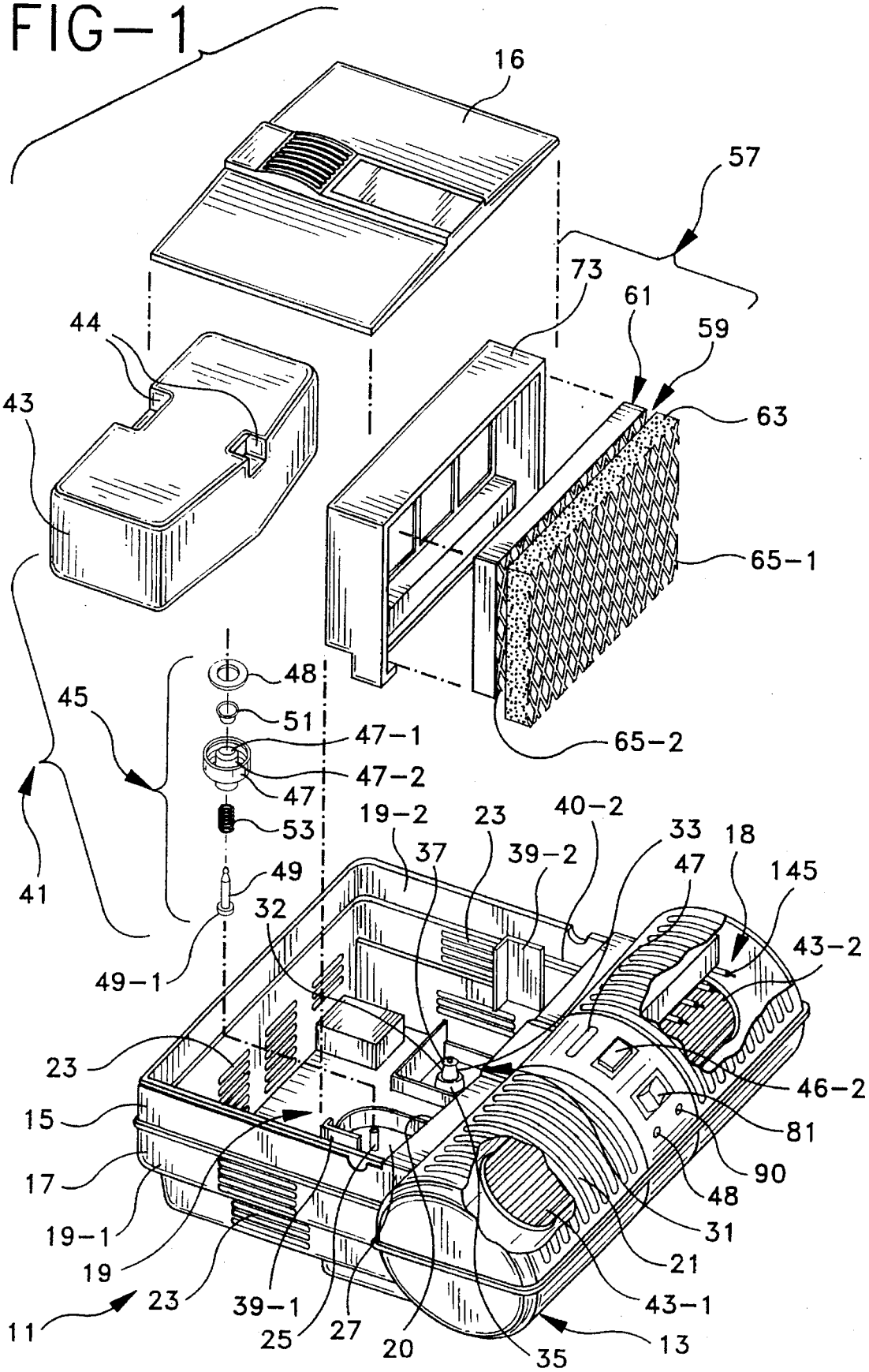
FIG. 1 is a partially exploded, top, front perspective view, broken away in part, of one embodiment of art air treatment system constructed according to the teachings of the present invention.
Figure 2:
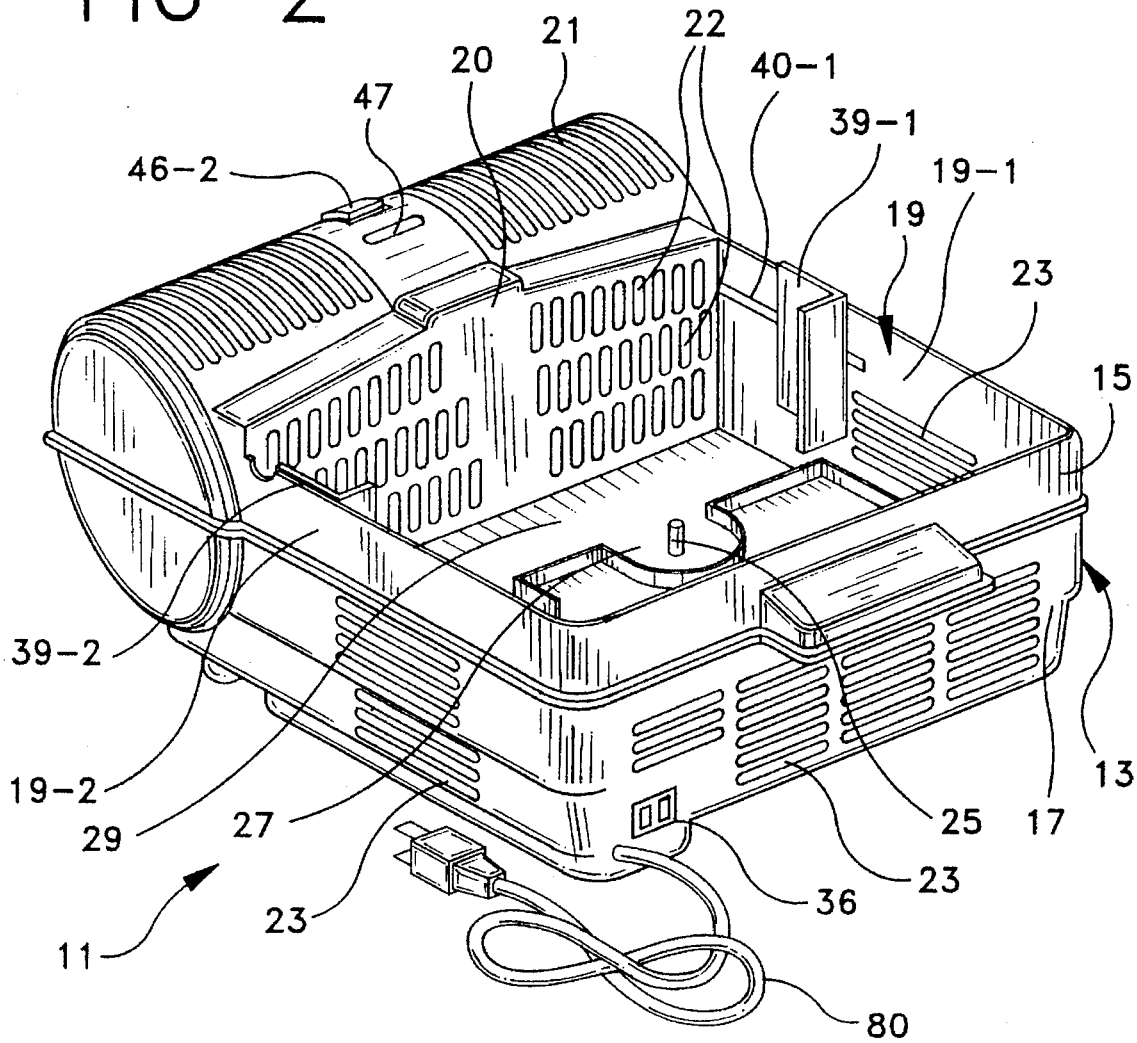
FIG. 2 is a top, rear, perspective view of the air treatment system of FIG. 1, the water supply means, the first filter assembly and the cover not being shown.

Referring now to the drawings and more particularly to FIGS. 1 and 2, there are shown partially exploded, top, front perspective and top, rear perspective views, respectively, of one embodiment of art air treatment system constructed according to the teachings of the present invention, the air treatment system being represented generally by reference numeral 11. Those aspects of system 11 not pertinent to the present invention are neither described nor shown herein.

Air treatment system 11 includes a housing 13. Housing 13 comprises a first top portion 15, a second top portion 16 and a bottom portion 17. When assembled, first top portion 15, second top portion 16 and bottom portion 17 together define a generally cylindrical front chamber 18 and a generally rectangular rear chamber 19 separated by an internal wall 20. First top portion 15 and bottom portion 17 are fixedly attached to one another by a plurality of screws (not shown). Second top portion 16 snap-fits together with first top portion 15 and acts as a removable cover for accessing the contents of rear chamber 19. The front of first top portion 15 is provided with a series of air outlet vents 21 which open into front chamber 18. The sides and rear of bottom portion 17 are similarly provided with a series of air inlet vents 23 which open into rear chamber 19. Front chamber 18 and rear chamber 19 communicate through a series of interchamber vents 22 in internal wall 20.

Rear chamber 19 is shaped to include an actuator stem 25, a liquid supply channel 27 and a reservoir 29. Actuator stem 25 projects upwardly from the bottom of rear chamber 19 and is used to actuate the discharge of water from a water supply tank to be hereinafter described into liquid supply channel 27. Liquid supply channel 27 serves to conduct the water discharged from the water supply tank into reservoir 29. Reservoir 29 holds the water for absorption by a wicking filter to be hereinafter described.

A pair of brackets 39-1 and 39-2 are slidably mounted on corresponding rails 40-1 and 40-2 which are mounted on opposing sidewalls 19-1 and 19-2, respectively, of chamber 19 in proximity to reservoir 29. Brackets 39 are used to hold alternative filter assemblies (to be described below in greater detail) upright within reservoir 29 and are slidably mounted so that one can match the size of the filter assembly being used.

Figure 3:
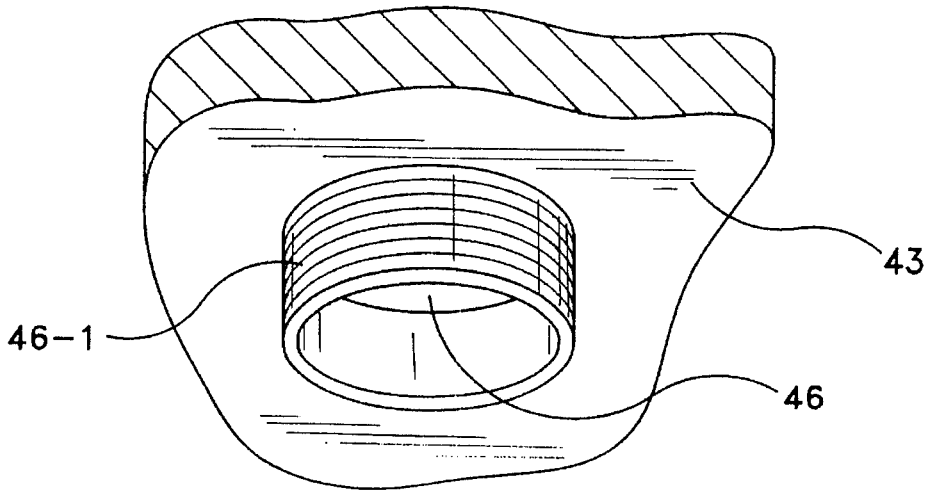
FIG. 3 is a fragmentary, bottom, perspective view of the water tank of FIG. 1.

Air treatment system 11 also includes water supply means 41 for delivering water to reservoir 29. Water supply means 41 comprises a water tank 43 removably mounted within chamber 19. The top of water tank 43 is shaped to define an integrally formed handle 44 for facilitating the removal and insertion of tank 43 from and into chamber 19. The bottom of water tank 43 is shaped to include an externally threaded collar 46-1 (see FIG. 3), collar 46-1 defining an opening 46 (see FIG. 3). When tank 43 is inserted in chamber 19, opening 46 is aligned with actuator stem 25.

Water supply means 41 also comprises a valve assembly 45 which, upon being actuated, permits water to be discharged through opening 46. Valve assembly 45 includes a cap 47, cap 47 having a central bore 47-1 defined by a collar 47-2. Cap 47 is internally threaded and is removably screwed onto collar 46-1. A washer 48 is inserted between cap 47 and collar 46-1 for creating a tight seal therebetween. A valve stem 49 having a button 49-1 at its bottom end is axially mounted within bore 47-1. A plug 51 is mounted on the top end of valve stem 49, plug 51 serving to plug bore 47-1 when stem 49 is in its upwardmost position. A spring 53 is inserted over stem. 49, spring 53 serving to bias stem 49 upwardly. In this manner, when button 49-1 is depressed by actuator stem 25, plug 51 is moved away from bore 47-1 and water is permitted to pass therethrough. When, however, button 49-1 is not depressed by actuator stem 25, plug 51 seals bore 47-1 and prevents water from passing therethrough.

System 11 also includes a liquid level sensor 31 which is used to activate a refill light 90 when the level of water in reservoir 29 falls below a pre-determined level. Sensor 31 includes a hollow float pole 33 which extends upwardly from the bottom wall of chamber 19 in reservoir 29. A read switch (not shown), which is electrically coupled to refill light 90, is housed inside float pole 33. A magnet 32 surrounded by an actuator float 33 is axially mounted on float pole 35. Float 33 floats upon the surface of water present in reservoir 29. A Rubber stopper 35 is mounted on the top of float pole 35 and serves to limit axial movement of float 33 on pole 35. In operation, when the level of water in reservoir 29 reaches a predetermined level, magnet 32 closes the read switch, thereby activating refill light 90.

Figure 4:
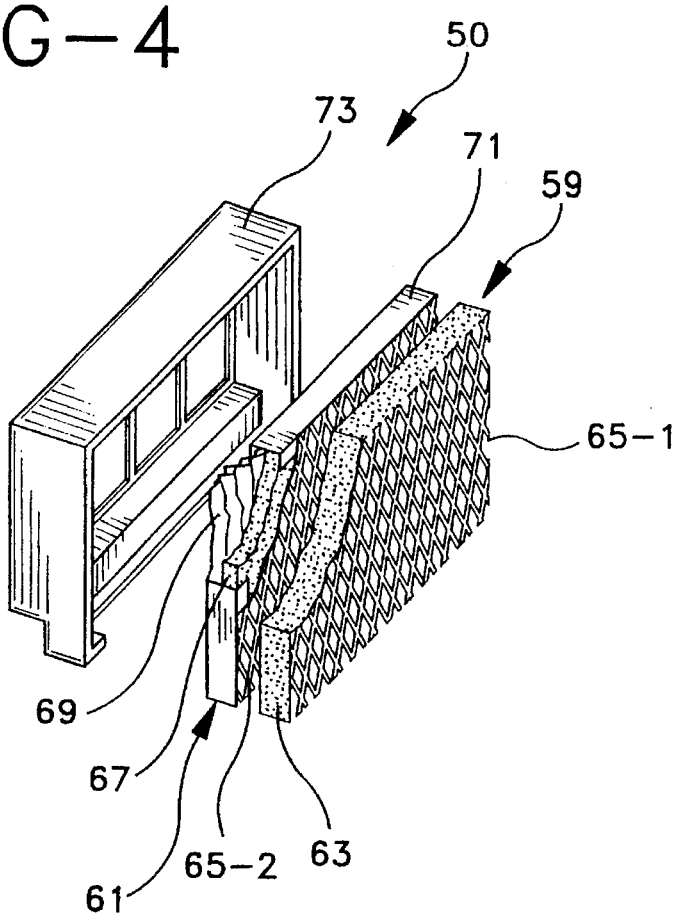
FIG. 4 is an enlarged, front, perspective view, broken away in part, of the first filter assembly shown in FIG. 1.

System 11 further includes a first filter assembly 57 which is adapted for use in those instances when air humidification as well as purification is desirable. As can be seen best in FIG. 4, first filter assembly 57 comprises an air humidification component 59 and an air purification component 61. Humidification component 59 comprises a wicking filter 63. Wicking filter 63 is a conventional honeycombed-shaped water-absorbent material which takes up water from reservoir 29 by capillary action. Humidification component 59 also includes a pair of honeycomb-shaped aluminum flames 65-1 and 65-2. Frames 65-1 and 65-2 are fixedly attached to the front and back sides, respectively, of wicking filter 63 and are used to impart structural rigidity thereto. Such rigidity is particularly useful when wicking filter 63 gets wet and tends to collapse due to the weight of the water absorbed thereby.

Air purification component 61 comprises a metallic rectangular frame 71 fixedly attached to the back of frame 65-2. An activated charcoal filter 67 and an electrostatically charged electric filter 69 are both housed within frame 71. Charcoal filter 67, which is-disposed at the front of frame 71, serves to remove odors from air passing therethrough. Electric filter 69, which is disposed at the rear of frame 71, serves to remove airborne particulates, such as tobacco smoke, dust, and pollen from air passing therethrough.

First filter assembly 57 further includes a plastic frame 73 in which components 59 and 61 are removably housed.

Figure 5:
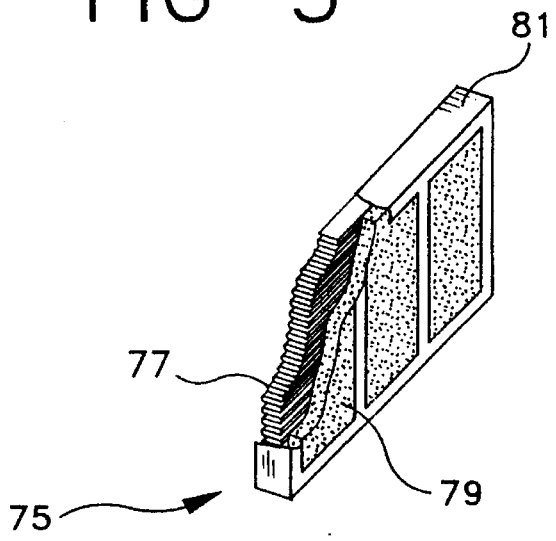
FIG. 5 is an enlarged, front, perspective view, broken away in part, of the second filter assembly constructed according to the teachings of the present invention.

Referring now to FIG. 5, system 11 also includes a second filter assembly 75, which is adapted for use in those instances when air purification without humidification is desirable. Assembly 75 comprises a cardboard frame 81. An activated charcoal filter 79 is positioned inside frame 81 at the front thereof and serves to remove odors from air passing therethrough. A High Efficiency Particulate Air (HEPA) filter 77 is positioned inside frame 81 at the rear thereof and serves to remove microscopic particulates (as small as 0.1 micron) from air passing therethrough.

Air treatment system 11 also includes fan means for drawing air in through air inlet vents 23, moving air across rear chamber 19, through vents 22 and into chamber 17, and exhausting air from chamber 17 through air outlet vents 21. Said means comprises in the present embodiment an electric motor (not shown), a left cylindrical fan blade 43-1, and a right cylindrical fan blade 43-2, all of which are disposed within cylindrical front chamber 18. Fan blades 43-1 and 43-2 are rotably mounted on a pair of shafts (not shown) on opposite sides of the electric motor. Electric power to the electric motor is supplied through wires (not shown) connected to a 3-setting (high-low-off) power switch 46-2 which, in turn, is connected to a power cord 80 adapted for insertion into an electrical outlet. A power indicator light 47 is mounted in the center of first top portion 15 on cylindrical from chamber, 18 and is also coupled to switch 46-2 to indicate that the motor 42 is operating.

Air treatment system 11 further includes a plurality of conventional, electrically activated, ionizer needles 145. Ionizer needles 145 which are used in the conventional manner to negatively charge air passing thereover, are mounted in cylindrical front chamber 18 between right cylindrical fan blade 43-2 and air outlet vents 21. Electric power to needles 145 is supplied through wires (not shown) connected to a 2-setting (on-off) ionizer switch 81 which, in turn, is connected to a power cord 80. An ionizer activation light 48 is mounted in the center of first top portion 15 on cylindrical front chamber 18 and is also coupled to switch 81 to indicate that needles 145 are being electrically charged.

System 11 is also provided with a convenience outlet 36, such as described in U.S. Ser. No. 08/118,934, which is incorporated herein by reference. Convenience outlet 36 is mounted on the back of bottom portion 17 and serves as a low wattage outlet for an additional electrical appliance.

To use system 11 to both humidify and purify air (as may be desirable, for example, in the wintertime), the following steps may be taken: First filter assembly 57 is positioned in reservoir 29 and water supply means 41 is removed from chamber 19. Valve assembly 45 is then removed from tank 43 and tank 43 is filled with water through opening 46. Valve assembly 45 is then placed back onto tank 43 and tank 43 is positioned in rear chamber 19 so that button 49-1 is depressed by actuator stem 25. The depression of button 49-1 by stem 25 causes water to be discharged from tank 43 into channel 27 and, thereafter, to flow into reservoir 29. Water present in reservoir 29 is then absorbed by capillary action by wicking filter 63 of first filter assembly 57.

When fan blades 43-1 and 43-2 are then turned on, by closing power switch 46-2, air is drawn into chamber 19 through air inlet vents 23 and through first filter assembly 57. Electric filter 69 first filters the circulated air of airborne particulates and charcoal filter 67 then filters the circulated air of odors. When the filtered air passes over moistened wicking filter 63, moisture is imparted thereto. The filtered and humidified air then passes through vents 22 into cylindrical front chamber 18.

If desired, the humidified and purified air can, thereafter, additionally be ionized by activating ionizer needles 45 and having the humidified and purified air pass thereover. The purified and humidified air, whether ionized or not, is then discharged from chamber 18 through vents 21.

To use system 11 to purify but not humidify air (as may be desirable, for example, in the summertime), the following steps may be taken: With chamber 19 and reservoir 29 being free of water (either by removing water supply means 41 from chamber 19 or by removing all water from tank 43), second filter assembly 75 is placed in reservoir 29. Fan blades 43-1 and 43-2 are then activated, causing air to enter chamber 19 through vents 23, and pass through second filter assembly 75. The air passing through second filter assembly 75 is first filtered of microscopic particulates (as small as 0.1 micron) by HEPA filter 77 and is then filtered of odors by charcoal filter 79. The purified air then passes into cylindrical front chamber 18 through vents 22. If desired, the purified air in chamber 18 may thereafter be additionally ionized by needles 145. The purified air, whether ionized or not, is then discharged from front chamber 18 through vents 21.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An air treatment system comprising:

a) a housing, said housing including a reservoir, air inlet means and air outlet means;

b) a fan mounted within said housing for drawing air into said housing through said air inlet means and for exhausting air from said housing through said air outlet means;

c) a water supply mounted within said housing and in fluid communication with said reservoir for supplying water to said reservoir;

d) a first filter assembly, said first assembly including a first air filter and a wicking filter, said first air filter and said wicking filter being independent of one another; and e) a second filter assembly, said second filter assembly comprising a second air filter, said first filter assembly and said second filter assembly being alternatively removably positionable in said reservoir.

2. The air treatment system as claimed in claim 1 wherein said first filter assembly further includes a third air filter.

3. The air treatment system as claimed in claim 2 wherein said first air filter of said first filter assembly is an electric filter and wherein said third air filter of said first filter assembly is an activated charcoal filter.

4. The air treatment system as claimed in claim 1 wherein said first filter assembly further includes means for reinforcing said wicking filter.

5. The air treatment system as claimed in claim 4 wherein said wicking filter is honeycomb-shaped and wherein said reinforcing means comprises a pair of honeycomb-shaped aluminum frames.

6. The air treatment system as claimed in claim 1 further comprising means for positioning said first and second filter assemblies in said reservoir.

7. The air treatment system as claimed in claim 1 wherein said housing is shaped to define a front cylindrical chamber and a rear rectangular chamber.

8. The air treatment system as claimed in claim 7 wherein said front cylindrical chamber and said rear rectangular chamber are separated by an internal wall, said internal wall being provided with a plurality of air vents.

9. The air treatment system as claimed in claim 1 wherein said second filter assembly further includes a fourth air filter.

10. The air treatment system as claimed in claim 9 wherein said second air filter of said second filter assembly is a HEPA filter and wherein said fourth air filter of said second filter assembly is an activated charcoal filter.

11. The air treatment system as claimed in claim 1 further comprising means for ionizing air drawn into said housing.

12. An air treatment system comprising:

a) a housing, said housing including a reservoir, air inlet means and air outlet means;

b) a fan mounted within said housing for drawing air into said housing through said air inlet means and for exhausting air from said housing through said air outlet means;

c) a water supply mounted within said housing and in fluid communication with said reservoir for supplying water to said reservoir;

d) a first filter assembly, said first assembly including an electric filter, an activated charcoal filter and a wicking filter;

e) a second filter assembly, said second filter assembly comprising a second air filter, said first filter assembly and said second filter assembly being alternatively removably positionable in said reservoir; and f) means for ionizing air drawn into said housing.

* * * * *

UNITED STATES PATENT AND TRADEMARK OFFICE

CERTIFICATE OF CORRECTION

PATENT NO. : 5,578,113

DATED : November 26, 1996

INVENTOR(S) : Glenn, Neville R.

It is certified that error appears in the above-indentified patent and that said Letters Patent is hereby corrected as shown below:

IN THE ABSTRACT:

| | |
|---|---|
| Item [57], Line 1, | now reads "having a from", should read --having a front--; an |
| Item [57], Line 24, | now reads "electric filter", should read --electret filter--. |
| Column 3, Line 54, | now reads "electric filter", should read --electret filter--; |
| Column 3, Line 55, | now reads "electric filter", should read --electret filter--; |
| Column 4, Line 29, | now reads "art air", should read --an air--; |
| Column 4, Line 50, | now reads "art air", should read --an air--; |
| Column 5, Line 44, | now reads "over stem. 49,", should read --over stem 49,--; |

UNITED STATES PATENT AND TRADEMARK OFFICE

CERTIFICATE OF CORRECTION

PATENT NO. : 5,578,113
DATED : November 26, 1996
INVENTOR(S) : Glenn, Neville R.

It is certified that error appears in the above-indentified patent and that said Letters Patent is hereby corrected as shown below:

| | |
|---|---|
| Column 6, Line 7, | now reads "flames 65-1", should read --frames 65-1--; |
| Column 6, Line 17, | now reads "electric filter", should read --electret filter--; |
| Column 6, Line 18, | now reads "which is-disposed", should read --which is disposed--; |
| Column 6, Line 20, | now reads "Electric filter", should read --Electret filter--; |
| Column 6, Line 51, | now reads "from chamber", should read --front chamber--; |
| Column 7, Line 19, | now reads "Electric filter", should read --Electret filter--; and |
| Column 7, Line 26, | now reads "needles 45", should read --needles 145--. |

UNITED STATES PATENT AND TRADEMARK OFFICE

CERTIFICATE OF CORRECTION

PATENT NO. : 5,578,113

DATED : November 26, 1996

INVENTOR(S) : Glenn, Neville R.

It is certified that error appears in the above-indentified patent and that said Letters Patent is hereby corrected as shown below:

IN THE CLAIMS:

Claim 3, Line 2, now reads "is an electric", should read --is an electret--; and Claim 12, Line 11, now reads "electric filter", should read --electret filter--.

Signed and Sealed this

Twenty-fifth Day of March, 1997

*Attest:*

BRUCE LEHMAN

*Attesting Officer*

*Commissioner of Patents and Trademarks*